US007007618B1

(12) United States Patent
Chiu

(10) Patent No.: US 7,007,618 B1
(45) Date of Patent: Mar. 7, 2006

(54) MOTOR SYSTEM FOR SEWING MACHINE

(76) Inventor: Yung-Ho Chiu, No. 26, Lane 48, White-Der Street, Pei-Tou District, Taipei (TW)

( * ) Notice: Subject to any disclaimer, the term of this patent is extended or adjusted under 35 U.S.C. 154(b) by 0 days.

(21) Appl. No.: 11/048,007

(22) Filed: Jan. 31, 2005

(51) Int. Cl.
*D05B 69/36* (2006.01)

(52) U.S. Cl. ..... 112/275

(58) Field of Classification Search ..... 112/220, 112/221, 271, 274, 275, 277
See application file for complete search history.

(56) References Cited

U.S. PATENT DOCUMENTS 4,259,915 A * 4/1981 Szostak ..... 112/217.4
5,189,968 A * 3/1993 Eichenseer ..... 112/470.01
5,481,165 A * 1/1996 Urano et al. ..... 318/5
5,522,330 A * 6/1996 Nishi et al. ..... 112/275
6,363,872 B1 * 4/2002 Heckner ..... 112/277

* cited by examiner

*Primary Examiner*—John J. Calvert
*Assistant Examiner*—Brian Kauffman
(74) *Attorney, Agent, or Firm*—Anderson Kill & Olick, PC

(57) ABSTRACT

A motor system for a sewing machine includes a motor unit rotatable at a first rotation speed; a clutch unit with an output shaft capable of being coupled to or separated from the motor unit; a speed changing unit for switching the first rotation speed to a second rotation speed; a position control unit with a sliding disk being movable to a first position, a second position or a third position, making the sliding disk rotate at the second or first rotation speed or stopped; an auxiliary driving shaft for transmitting the rotation of the sliding disk to the output shaft; a first sensor for detecting the position of the clutch unit; and a second sensor for detecting the position of a sewing mechanism of the sewing machine. Thereby, a first speed control, a second speed control and a stopping position control can be achieved for the sewing mechanism.

16 Claims, 6 Drawing Sheets

MOTOR SYSTEM FOR SEWING MACHINE

FIELD OF THE INVENTION

The present invention relates to motor systems for sewing machines, and more particularly, to a motor system that can only use one motor to realize a first speed control, a second speed control and a stopping position control for a sewing mechanism of a sewing machine.

BACKGROUND OF THE INVENTION

Since electric sewing can accurately control a sewing speed, increase the throughput and improve the sewing quality, most industrial sewing machines and household sewing machines have been equipped with electric motors to become electric sewing machines. A sewing mechanism of the electric sewing machine is typically driven by the motor via a belt. Generally, when stopping a sewing operation of the sewing machine, it is expected that a needle of the sewing mechanism can be held right at its topmost position, such that a maximum space exists between the needle and an underneath seat of the sewing machine to allow easy movement of a fabric being sewn or change of a thread being used, etc. Therefore, an accurate stopping position control is required for the sewing machine.

Due to cost considerations, a motor for a sewing machine is generally an induction motor that can not perform a positioning control itself. Moreover, as it is usually necessary to resume high-speed sewing within a very short period of time after temporarily stopping the sewing operation, the main motor for the sewing machine must be always kept rotating at a high rotation speed. Accordingly, the motor system for the sewing machine is often provided with an additional control system and mechanism for the purpose of accurately positioning the needle and immediately resuming high-speed sewing.

FIG. 6 is a cross-sectional view of a conventional stopping position control motor system 5 for a sewing machine. As shown in FIG. 6, the conventional stopping position control motor system 5 comprises a main motor unit 51, a clutch unit 52, and a deceleration unit 53. The main motor unit 51 comprises a motor casing 515, a stator 511 and a rotor 512 that are accommodated within the motor casing 515, a motor main shaft 513, and a motor flywheel 514 fixed on a front end of the motor main shaft 513. The clutch unit 52 comprises a drawbar 525 pivoted on the motor casing 515, a sliding sleeve 521 that can slide forwardly and backwardly by actuation of a front portion of the drawbar 525, an output shaft 522 rotatably connected to the sliding sleeve 521, a clutch disk 523 fixed on a back end of the output shaft 522, and a friction pad 524 attached to a surface of the clutch disk 523 facing toward the motor flywheel 514. Moreover, a belt pulley (not shown) for coupling a belt can be provided on a front end of the output shaft 522 to drive a sewing mechanism (not shown) of the sewing machine through the belt. The deceleration unit 53 comprises a large-sized gear disk 532 supported on the motor casing 515 by a large-sized bearing 531, a friction pad 533 attached to a surface of the large-sized gear disk 532 facing toward the clutch disk 523, a deceleration motor shaft 534 having a worm gear and for driving the large-sized gear disk 532 to rotate at a second rotation speed (low rotation speed), a deceleration motor (not shown) for driving the decelerating motor shaft 534, and a brake mechanism (not shown) provided on a back end of the decelerating motor.

When power is turned on, the rotor 512 and the stator 511 of the main motor unit 51 are actuated by the power to drive the motor main shaft 513 and the motor flywheel 514 to rotate at a first rotation speed (high rotation speed). When a sewing operation of the sewing machine is to be carried out, the drawbar 525 is pulled upwardly in FIG. 6 to actuate the sliding sleeve 521 to move to a contact position and actuate the output shaft 522 and the clutch disk 523 to move backwardly, such that the clutch disk 523 abuts against and presses the motor flywheel 514. As a result, the clutch disk 523 is immediately driven by a friction force between the friction pad 524 and the motor flywheel 514, making the clutch disk 523 and the output shaft 522 start rotating at the first rotation speed promptly and thus driving the sewing mechanism of the sewing machine to perform the sewing operation at a first speed (high speed). When the sewing operation is to be stopped, the drawbar 525 is pushed downwardly in FIG. 6 to actuate the sliding sleeve 521 to move to a separation position and drive the output shaft 522 and the clutch disk 523 to move forwardly, such that the clutch disk 523 is disengaged from the motor flywheel 514 and is coupled to the large-sized gear disk 532 by a friction force between the friction pad 533 and the clutch disk 523. Since the large-sized gear disk 532 rotates at the second rotation speed (low rotation speed), the sewing operation is carried out by the sewing mechanism of the sewing machine at a second speed (low speed). Then, when the needle of the sewing mechanism reaches its topmost position, a signal is sent from a sensor such as a magnetic switch or photo sensor (not shown) to turn off the power supplied to the deceleration motor and actuate the brake mechanism at the same time to stop the rotation of the deceleration motor, such that the rotation of the large-sized gear disk 532 and the sewing operation are terminated.

However, since the large-sized bearing 531 has a relatively large size and the large-sized gear disk 532 needs to cooperate with the deceleration motor shaft 534 to perform worm-gear processing, the fabrication cost of the large-sized bearing 531 and the large-sized gear disk 532 is relatively high, thereby making the overall cost of the stopping position control motor system 5 for the sewing machine significantly increased. Accordingly, the problem to be solved here is to provide a motor system for a sewing machine, which can realize a first speed control, a second speed control and a stopping position control without having to use a decelerating motor, so as to reduce the overall cost of the motor system for the sewing machine.

SUMMARY OF THE INVENTION

In light of the aforementioned drawbacks in the prior art, a primary objective of the present invention is to provide a motor system for a sewing machine, which can only use one motor to realize a first speed control, a second speed control and a stopping position control for a sewing mechanism of the sewing machine, such that the cost of the motor system is reduced.

In accordance with the above and other objectives, the present invention proposes a motor system for a sewing machine, comprising a motor unit rotatable at a first rotation speed; an auxiliary driving shaft penetrating the motor unit without affecting rotation of the motor unit, the auxiliary driving shaft having a first end and a second end opposite to the first end; a clutch unit at least having an output shaft, wherein the clutch unit can be controlled to be coupled to or separated from the motor unit, and wherein an end portion of the output shaft facing toward the motor unit is coupled to the first end of the auxiliary driving shaft such that the output shaft and the auxiliary driving shaft can slide with respect to each other in a longitudinal direction, and the other end portion of the output shaft opposite to the motor unit is used for driving a sewing mechanism of the sewing machine; a speed changing unit mounted on a side of the motor unit opposite to the clutch unit, and having an output portion for switching the first rotation speed of the motor unit to a second rotation speed; a position control unit mounted on a side of the speed changing unit opposite to the motor unit, wherein the position control unit at least has a sliding disk slidingly connected to the second end of the auxiliary driving shaft in a longitudinal direction (such that the sliding disk can slide with respect to the auxiliary driving shaft in the longitudinal direction), a positioning mechanism for actuating the sliding disk in a non-contact manner to position the sliding disk at a first position, a second position or a third position in the longitudinal direction, and a brake mechanism, wherein the sliding disk when being situated at the first position is in contact with the output portion of the speed changing unit, the sliding disk when being situated at the second position is not in contact with the speed changing unit or the brake mechanism, and the sliding disk when being situated at the third position is in contact with the brake mechanism; a first sensor for sending a signal according to a status of coupling or separating between the clutch unit and the motor unit; and a second sensor for sending a signal according to an intended stopping position of the sewing mechanism of the sewing machine; wherein the sliding disk is positioned by the positioning mechanism according to the signals sent from the first sensor and the second sensor.

In one preferred embodiment of the motor system for the sewing machine according to the present invention, the second rotation speed is lower than the first rotation speed. When the clutch unit is coupled to the motor unit, the sliding disk is moved to the second position by the positioning mechanism at the same time, such that the output shaft is directly actuated by the motor unit to rotate at the first rotation speed. When the clutch unit is separated from the motor unit and the sewing mechanism has not reached the intended stopping position yet, the sliding disk is moved to the first position by the positioning mechanism, and the output shaft is actuated by the output portion of the speed changing unit via the auxiliary driving shaft to rotate at the second rotation speed. When the clutch unit is separated from the motor unit and the sewing mechanism has reached the intended stopping position, the sliding disk is moved to the third position by the positioning mechanism, and the rotation of the output shaft can be stopped by the brake mechanism via the auxiliary driving shaft.

Accordingly, when a sewing operation is to be performed, the sliding disk is moved to the second position, so as to make the output shaft rotate at a relatively higher rotation speed (i.e. the first rotation speed) and consequently drive the sewing mechanism to operate at a relatively higher first speed. When the sewing operation is to be stopped, firstly the sliding disk is moved to the first position so as to make the output shaft rotate at a relatively lower rotation speed (i.e. the second rotation speed) and consequently drive the sewing mechanism to operate at a relatively lower second speed, and then, when the sewing mechanism reaches the intended stopping position, the sliding disk is moved to the third position and thus the rotation of the output shaft and the operation of the sewing mechanism are terminated. Thereby, an accurate stopping position control for the sewing mechanism can be realized.

In one preferred embodiment of the motor system for the sewing machine according to the present invention, the motor unit at least has a hollow motor shaft, and a motor flywheel fixed on an end portion of the hollow motor shaft facing toward the clutch unit, wherein the auxiliary driving shaft penetrates the hollow motor shaft without affecting rotation of the hollow motor shaft. The clutch unit further comprises a sliding sleeve, which can slide in its longitudinal direction with respect to the motor casing and is rotatably connected to the output shaft; and a clutch disk fixed on an end portion of the output shaft facing toward the motor unit. Thereby, the output shaft and the clutch disk can slide in the longitudinal direction together with the sliding sleeve and can rotate with respect to the sliding sleeve. When the sliding sleeve slides to a contact position, the clutch disk is in contact with and coupled to the motor flywheel. When the sliding sleeve slides to a separation position, the clutch disk is separated from the motor flywheel.

In one preferred embodiment of the motor system for the sewing machine according to the present invention, the clutch unit further comprises a drawbar pivoted on the motor casing, wherein the sliding sleeve can be actuated by the drawbar to slide to the contact position or the separation position.

In another preferred embodiment of the motor system for the sewing machine according to the present invention, the clutch unit further comprises an electromagnetic driving mechanism, wherein the sliding sleeve is actuated by the electromagnetic driving mechanism to slide to the contact position or the separation position.

In a further preferred embodiment of the motor system for the sewing machine according to the present invention, the clutch unit further comprises a hydraulic driving mechanism, wherein the sliding sleeve is actuated by the hydraulic driving mechanism to slide to the contact position or the separation position.

In one preferred embodiment of the motor system for the sewing machine according to the present invention, the position control unit further comprises a driving wheel fixed on the second end of the auxiliary driving shaft and slidingly connected to the sliding disk such that the driving wheel and the sliding disk can slide with respect to each other in the longitudinal direction.

In one preferred embodiment of the motor system for the sewing machine according to the present invention, the first sensor is a micro switch.

In one preferred embodiment of the motor system for the sewing machine according to the present invention, the second sensor sends a signal when a needle of the sewing mechanism of the sewing machine reaches its topmost position.

In one preferred embodiment of the motor system for the sewing machine according to the present invention, the brake mechanism is fixed on the positioning mechanism, and the sliding disk is disposed between the positioning mechanism and the speed changing unit.

In one preferred embodiment of the motor system for the sewing machine according to the present invention, the positioning mechanism comprises a first solenoid and a second solenoid, which are disposed oppositely and can be turned on or turned off independently. The sliding disk is moved to the first position when the first solenoid is turned on and the second solenoid is turned off. The sliding disk is moved to the second position when both the first solenoid and the second solenoid are turned off. And the sliding disk is moved to the third position when the first solenoid is turned off and the second solenoid is turned on.

In one preferred embodiment of the motor system for the sewing machine according to the present invention, the positioning mechanism further comprises a pushing sleeve rotatably abutting against the sliding disk, wherein when the first solenoid is turned on, the pushing sleeve is attracted by the first solenoid to push the sliding disk to the first position; and a spring having elasticity capable of moving the pushing sleeve back to its original position where the sliding disk is not pressed by the pushing sleeve when the first solenoid is turned off.

In one preferred embodiment of the motor system for the sewing machine according to the present invention, the speed changing unit further comprises a low speed rotating disk that can rotate at the second rotation speed, wherein when the sliding disk of the position control unit is in the first position, the sliding disk is in contact with and coupled to the low speed rotating disk.

Accordingly, when the sliding sleeve of the clutch unit is in the contact position and the sliding disk of the position control unit is in the second position, the clutch disk of the clutch unit is engaged with the motor flywheel of the motor unit, and the sliding disk is not engaged with the low speed rotating disk or the brake mechanism, that is, the sliding disk is in a state of free rotation, such that the output shaft of the clutch unit is driven by only the motor flywheel to rotate at the first rotation speed (high rotation speed). Moreover, when the sliding sleeve is in the separation position where the clutch disk is separated from the motor flywheel, and the sliding disk is in the first position and engaged with the low speed rotating disk, the output shaft is driven by the low speed rotating disk through the auxiliary driving shaft to rotate at the second rotation speed (low rotation speed). Furthermore, when the sliding sleeve is in the separation position where the clutch disk is separated from the motor flywheel, and the sliding disk is in the third position and in contact with the brake mechanism, the output shaft is braked and stopped by the brake mechanism through the auxiliary driving shaft. Since a belt pulley or the like can be attached to a front end of the output shaft to drive the sewing machine via a belt coupled to the belt pulley, the sewing mechanism of the sewing machine can be controlled to operate at the high or low speed or to stop completely at the stopping position through the use of a single motor, wherein it is not necessary to stop rotation of this motor during the control processes.

Therefore, an accurate stopping position control can be achieved without requiring any additional deceleration motor, and thus the cost is reduced. Moreover in the present invention, since the motor is not stopped, the sewing operation can be resumed promptly any time after being temporarily terminated, thereby providing an effect of instant resumption of the sewing operation.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Preferred embodiments of a motor system for a sewing machine proposed in the present invention are described in detail as follows with reference to FIGS. 1 to 4.

First Preferred Embodiment

Figure 1:
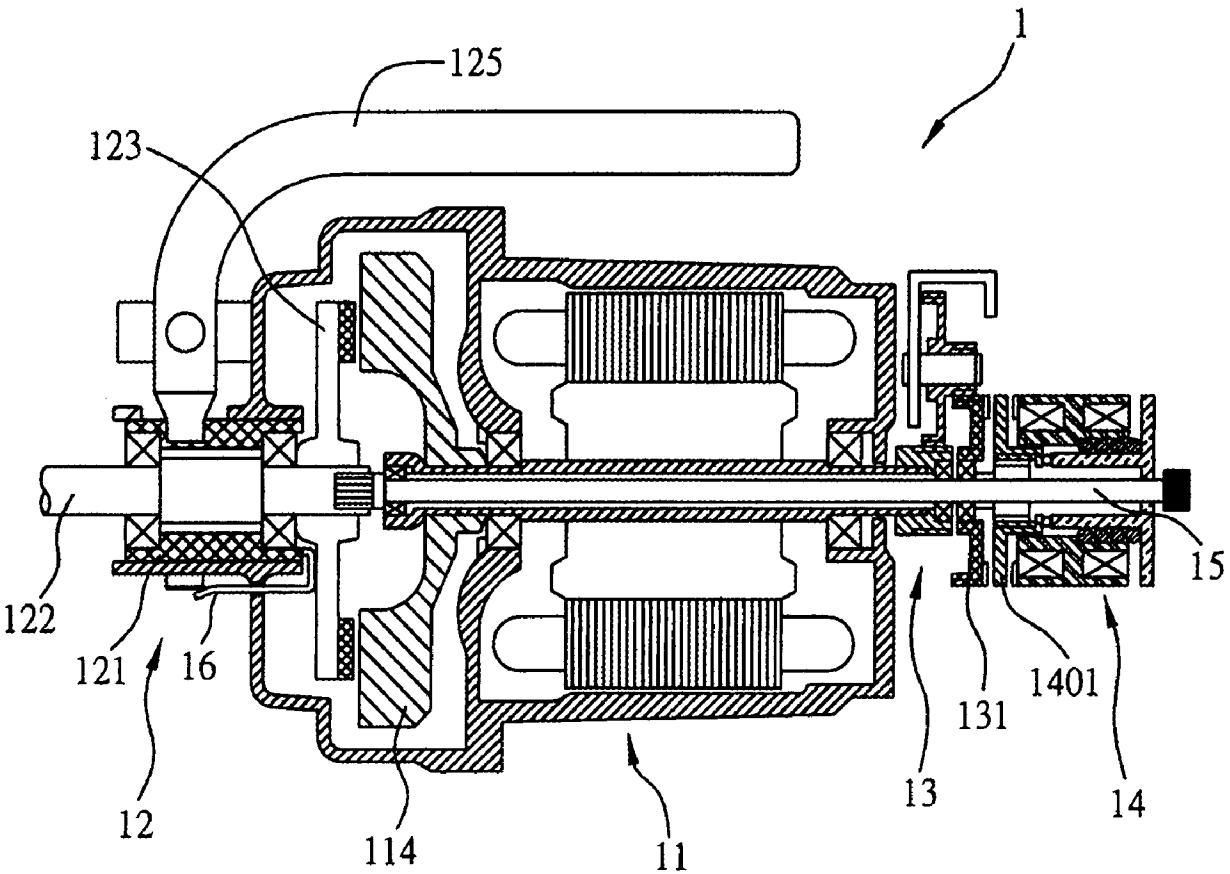
FIG. 1 is a cross-sectional view of a motor system for a sewing machine according to a first preferred embodiment of the present invention.
Figure 2:
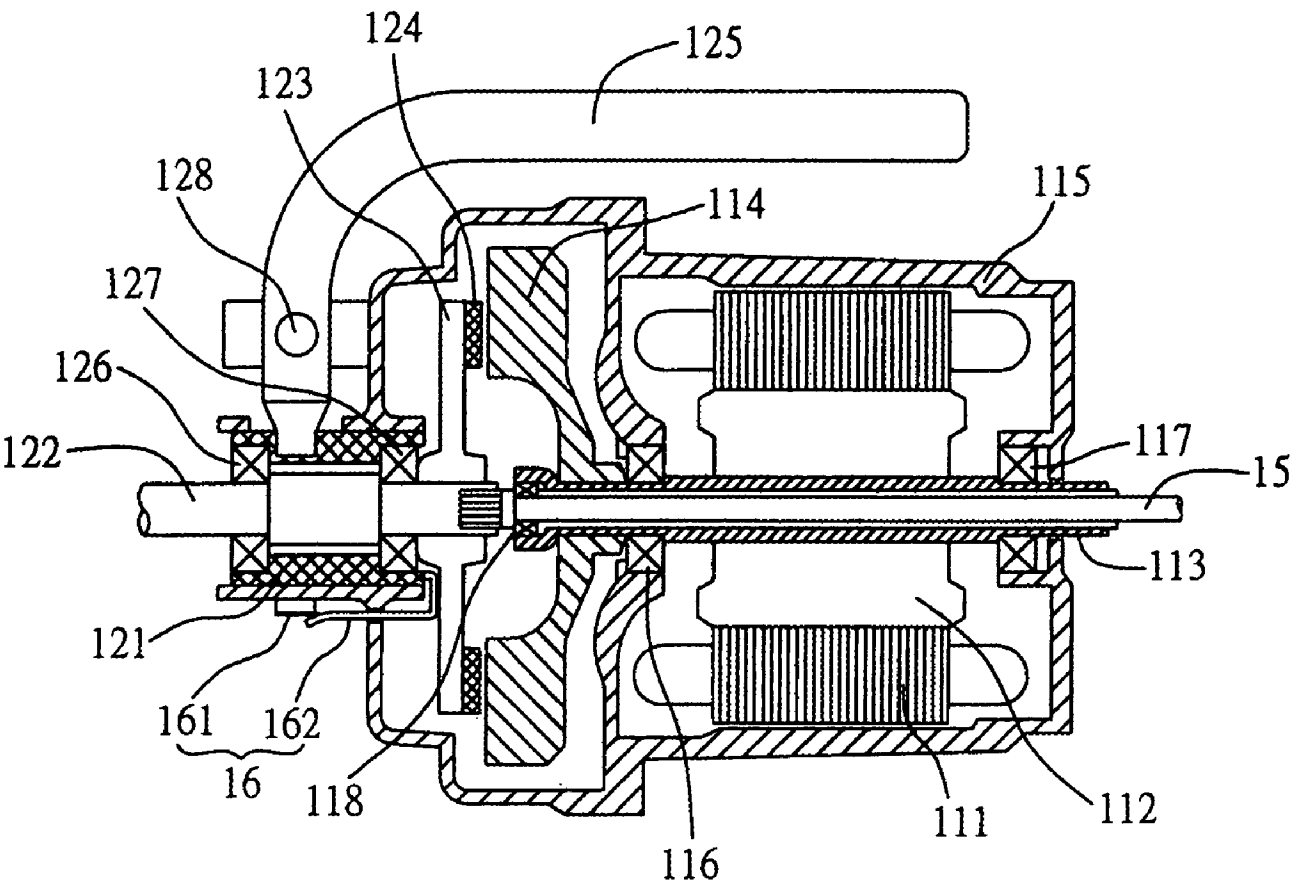
FIG. 2 is an enlarged cross-sectional view showing a part of the motor system according to the first preferred embodiment of the present invention.
Figure 3:
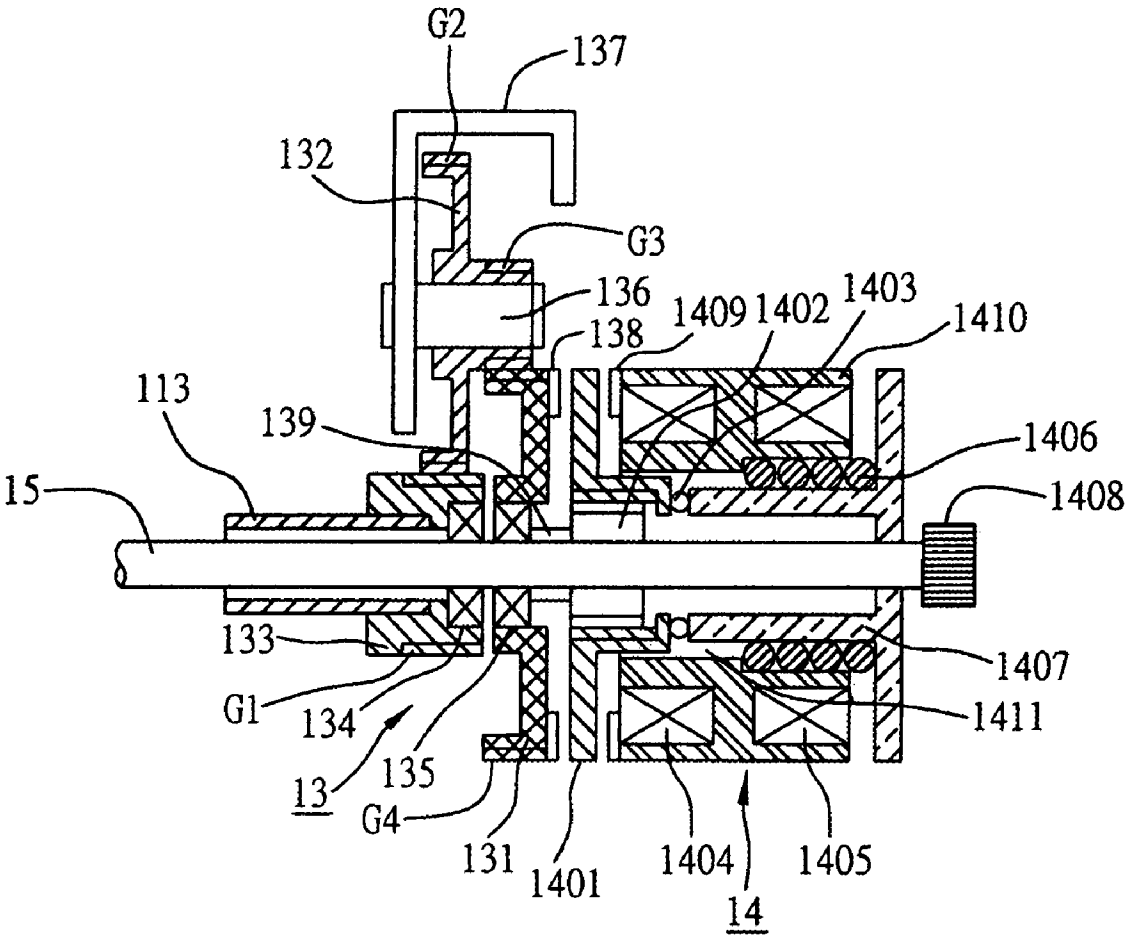
FIG. 3 is an enlarged cross-sectional view showing another part of the motor system according to the first preferred embodiment of the present invention.
Figure 5:
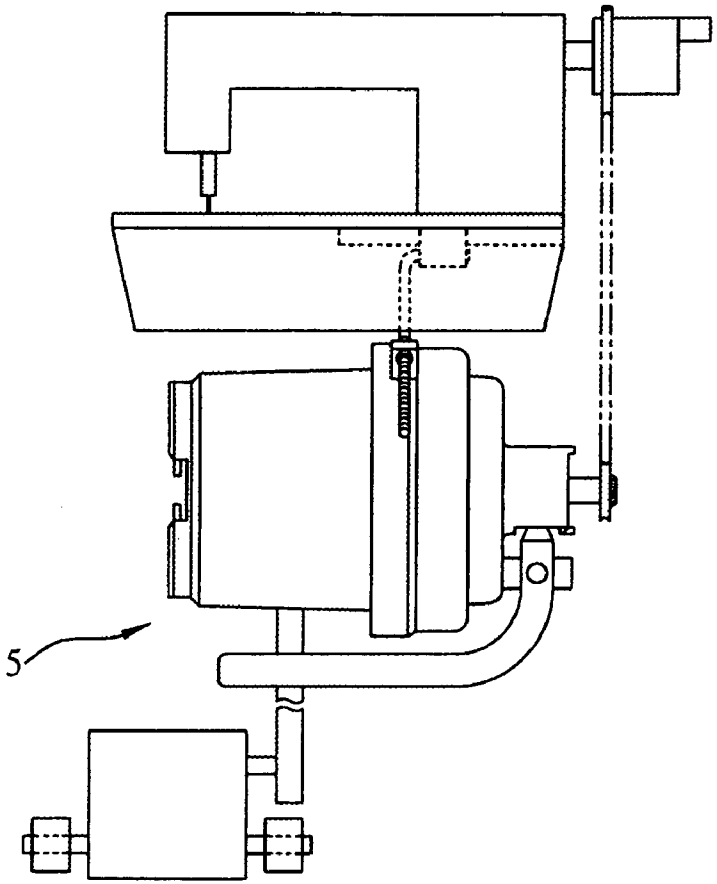
FIG. 5 is a schematic diagram of the sewing machine with the motor system according to the present invention.
Figure 6:
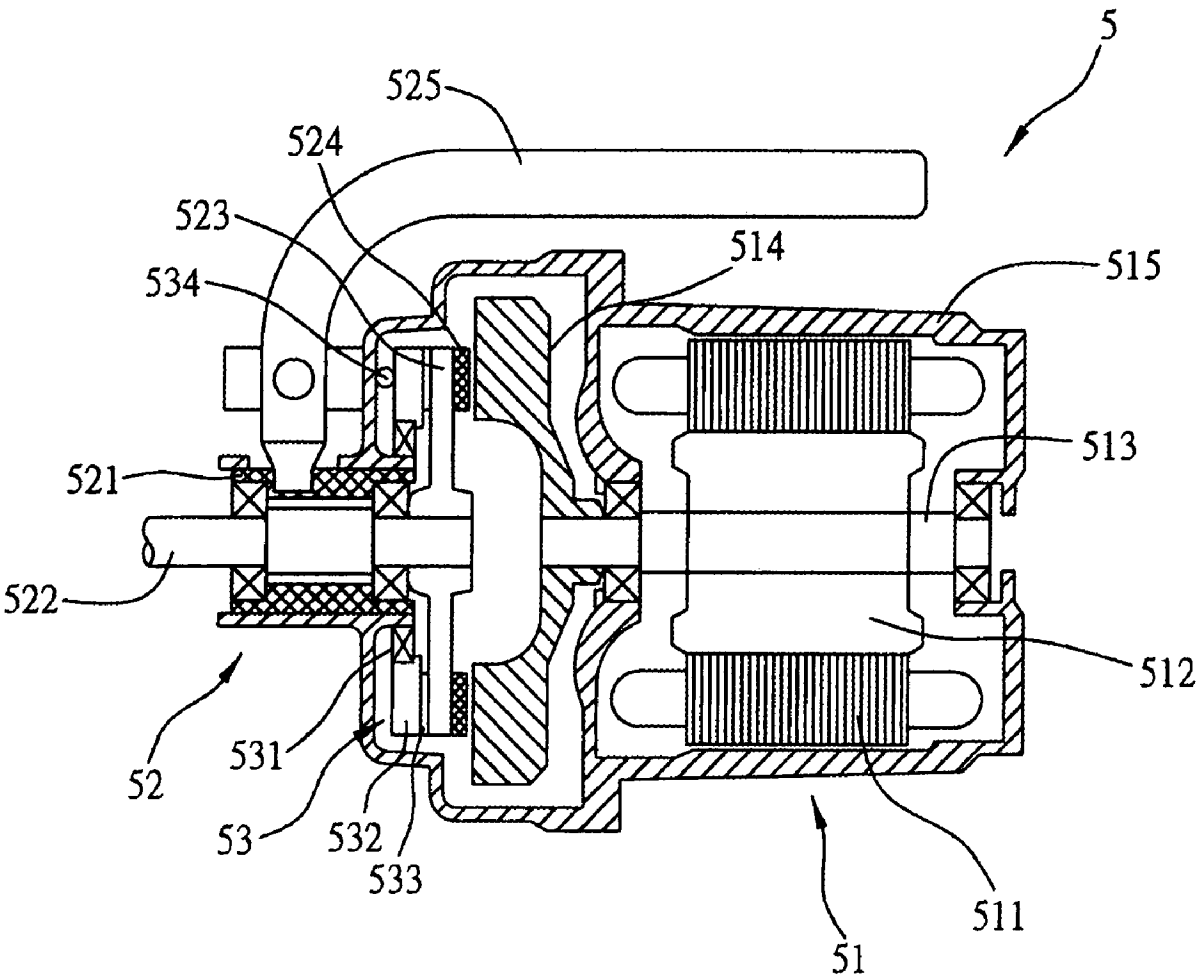
FIG. 6 (PRIOR ART)
FIG. 6 (PRIOR ART) is a cross-sectional view of a conventional motor system for a sewing machine.

FIG. 1 is a cross-sectional view of a motor system for a sewing machine according to a first preferred embodiment of the present invention. FIG. 2 is an enlarged cross-sectional view showing a part of the motor system according to the first preferred embodiment of the present invention. FIG. 3 is an enlarged cross-sectional view showing another part of the motor system according to the first preferred embodiment of the present invention. FIG. 5 is a schematic diagram of the sewing machine with the motor system according to the present invention. Referring to FIGS. 1 and 5, the motor system 1 for a sewing machine according to the present invention comprises a motor unit 11, a clutch unit 12, a speed changing unit 13, a position control unit 14, an auxiliary driving shaft 15, a first sensor 16, and a second sensor 17.

As shown in FIG. 2, the motor unit 11 comprises a motor casing 115; a stator 111 and a rotor 112 that are accommodated within the motor casing 115; a hollow motor shaft 113 fixed in the rotor 112; a motor flywheel 114 fixed on a front portion of the motor shaft 113; bearings 116, 117 for supporting the motor shaft 113 in the motor casing 115; and a bearing 118 for supporting the motor shaft 113 on the auxiliary driving shaft 15.

The clutch unit 12 is mounted at a front side (the left side in FIG. 2) of the motor unit 11. The clutch unit 12 comprises a sliding sleeve 121 accommodated within a front portion of the motor casing 115 and capable of sliding forwardly and backwardly; bearings 126, 127; an output shaft 122 rotatably connected to the sliding sleeve 121 via the bearings 126, 127; a clutch disk 123 fixed on a back end of the output shaft 122; a friction pad 124 provided on a surface of the clutch disk 123 facing toward the motor flywheel 114; a drawbar shaft 128; and a drawbar 125 pivoted on the motor casing 115 via the drawbar shaft 128, wherein the sliding sleeve 121 is actuated by a front portion of the drawbar 125 to move forwardly and backwardly. Accordingly, when the drawbar 125 is pulled upwardly in FIG. 2, the sliding sleeve 121 is actuated to move to a contact position (back position), and the clutch disk 123 is consequently driven to move backwardly to be in contact with the motor flywheel 114, such that the clutch disk 123 is coupled to the motor flywheel 114 by a friction force of the friction pad 124. Moreover, when the drawbar 125 is pushed downwardly in FIG. 2, the sliding sleeve 121 is actuated to move to a separation position (front position), and the clutch disk 123 is consequently driven to move forwardly to be separated from the motor flywheel 114.

As shown in FIG. 3, the speed changing unit 13 is provided at a back side (the right side of FIG. 3) of the motor unit 11. The speed changing unit 13 comprises: a casing 137; a gear shaft 136 fixed on the casing 137; bearings 134, 135; a central gear 133 fixed on a back portion of the motor shaft 113 and having a set of gear teeth G1, wherein the central gear 133 is rotatably connected to the auxiliary driving shaft 15 via the bearing 134; an outer gear 132 rotatable about the gear shaft 136, and having a first set of gear teeth G2 and a second set of gear teeth G3, wherein the first set of gear teeth G2 is engaged with the set of gear teeth G1 of the central gear 133; a low speed rotating disk 131 rotatably connected to the auxiliary driving shaft 15 via the bearing 135, and having a set of gear teeth G4 engaged with the second set of gear teeth G3 of the outer gear 132; a friction pad 138 provided on a surface of the low speed rotation speed 131 facing toward the position control unit 14; and a rotating washer 139 provided on the auxiliary driving shaft 15 and disposed between the low speed rotating disk 131 and the position control unit 14. For example, a reduction ratio between the two sets of gear teeth G1, G2 is 1/2, and a reduction ratio between the two sets of gear teeth G3, G4 is 18/63. Since the central gear 133 is fixed on the motor shaft 113, it would rotate at a first rotation speed (high rotation speed) along with the motor unit 11. Then, the low speed rotating disk 131 can rotate at a second rotation speed (low rotation speed) through deceleration of the outer gear 132. Moreover, the rotating washer 139 may be made of a wear-resistant material such as ceramic or Teflon.

The position control unit 14 is mounted at a back side of the speed changing unit 13. The position control unit 14 comprises: a main body 1410 having a through hole 1411; a sliding disk 1401 accommodated within the through hole 1411; a driving wheel 1402 fixed on the auxiliary driving shaft 15 and slidingly connected to the sliding disk 1401 in a longitudinal direction of the through hole 1411; a plurality of rolling beads 1403 provided on a surface of a back portion of the sliding disk 1401; a pushing sleeve 1407 accommodated within the through hole 1411 and disposed at a back side of the sliding disk 1401; at least one spring 1406 provided within the through hole 1411 and capable of pushing the pushing sleeve 1407 backwardly; a first solenoid 1405 and a second solenoid 1404 that are received in the main body 1410; a gap adjuster 1408 fixed on a back end of the auxiliary driving shaft 15; and a friction pad 1409 attached to a surface of a front side of the main body 1410. The sliding disk 1401 is slidingly connected to the driving wheel 1402 in the longitudinal direction of the through hole 1411 by means of a mechanism such as sliding gear, etc. When the first solenoid 1405 is turned on and the second solenoid 1404 is turned off, the pushing sleeve 1407 is attracted by the first solenoid 1405 to move forwardly and press the sliding disk 1401 to a first position (front position) through the rolling beads 1403. Thus, the sliding disk 1401 is coupled to the low speed rotating disk 131 by a friction force of the friction pad 138 and rotates at the second rotation speed. When the first solenoid 1405 is turned off and the second solenoid 1404 is turned on, the pushing sleeve 1407 is actuated by resilience of the spring 1406 to move back to its original position where the pushing sleeve 1407 does not press the sliding disk 1401, such that the sliding disk 1401 is attracted by the second solenoid 1404 to move to a third position (back position), and is braked and stopped by a friction force of the friction pad 1409. When both the first solenoid 1405 and the second solenoid 1404 are turned off, the sliding disk 1401 is moved to a second position (middle position), and thus is not coupled to the low speed rotating disk 131 or in contact with the friction pad 1409. Moreover, the first solenoid 1405 and the second solenoid 1404 are turned on or turned off according to signals from the first sensor 16 and the second sensor 17.

The auxiliary driving shaft 15 is mounted in the motor system 1, and penetrates the motor unit 11, the speed changing unit 13 and the position control unit 14. Further referring to FIG. 2, a front end of the auxiliary driving shaft 15 is connected to the back end of the output shaft 122 of the clutch unit 12 by for example a sliding gear, such that the output shaft 122 and the auxiliary driving shaft 15 can slide with respect to each other in a longitudinal direction. Thus, even when the sliding sleeve 121 of the clutch unit 12 is in its front position, the connection between the auxiliary driving shaft 15 and the output shaft 122 is still maintained. Furthermore, as the auxiliary driving shaft 15 is rotatably connected to the front portion of the hollow motor shaft 113 by the bearing 118, the auxiliary driving shaft 15 can penetrate the motor shaft 113 without affecting rotation of the motor shaft 113. Further referring to FIG. 3, as the auxiliary driving shaft 15 is rotatably connected to the central gear 133 and the low speed rotating disk 131 by the bearings 134, 135 respectively, the auxiliary driving shaft 15 can penetrate the speed changing unit 13 without affecting the operation of the speed changing unit 13. Moreover, since the driving wheel 1403 of the position control unit 14 is fixed on the auxiliary driving shaft 15 and the sliding disk 1401 is slidingly connected to the driving wheel 1403, the auxiliary driving shaft 15 and the sliding disk 1401 have the same rotation speed.

As shown in FIG. 2, the first sensor 16 is mounted at the front portion of the motor casing 115, and comprises a micro switch 161 provided on the motor casing 115, and a sensing plate 162 fixed on the sliding sleeve 121 and penetrating the motor casing 115. When the sliding sleeve 121 is moved to its back position, the sensing plate 162 is also moved backwardly so as to release a button mechanism of the micro switch 161. When the sliding sleeve 121 is moved to its front position, the sensing plate 162 is also moved forwardly so as to press the button mechanism of the micro switch 161. Thereby, the first sensor 16 can send a corresponding signal according to the position of the sliding sleeve 121. It should be understood that, the present invention is not limited to the micro switch, but other mechanisms such as a photo sensor or magnetic switch, etc. can also be used for the first sensor 16.

As shown in FIG. 5, the second sensor 17 can be mounted on a main body of the sewing machine and is adapted to send a corresponding signal when the sewing mechanism is situated at an intended stopping position, for example, a needle of the sewing mechanism reaching its topmost position. The second sensor 17 may comprise for example a photo sensor, magnetic switch, micro switch, etc.

When a sewing operation is to be performed, the drawbar 125 is pulled upwardly in FIG. 1 or 2 to move the sliding sleeve 121 to its back position. At the same time, since the clutch disk 123 is coupled to the motor flywheel 114, and the first solenoid 1405 and the second solenoid 1404 of the position control unit 14 are turned off according to the signal from the first sensor 16, the output shaft 122 and the auxiliary driving shaft 15 would both rotate at the first rotation speed (high rotation speed) to consequently drive the sewing mechanism of the sewing machine via a belt pulley and a belt provided at a front end of the output shaft 122, so as to carry out the sewing operation.

When the sewing operation is to be stopped, the drawbar 125 is pushed downwardly in FIG. 1 or 2 to move the sliding sleeve 121 to its front position. At the same time, since the sewing mechanism has not yet reached the intended stopping position, the first solenoid 1405 is turned on and the second solenoid 1404 is turned off according to the signals from the first sensor 16 and the second sensor 17. And since the clutch disk 123 is separated from the motor flywheel 114 and the sliding disk 1401 is coupled to the low speed rotating disk 131, the output shaft 122 and the auxiliary driving shaft 15 would both rotate at the second rotation speed (low rotation speed) to consequently drive the sewing mechanism to operate at a lower speed, so as to prepare to stop the sewing operation.

Next, when the sewing mechanism has reached the intended stopping position, the first solenoid 1405 is turned off and the second solenoid 1404 is turned on according to the signals from the first sensor 16 and the second sensor 17. At the same time, since the clutch disk 123 is separated from the motor flywheel 114, and the sliding disk 1401 is braked and stopped by the friction pad 1409, the output shaft 122 and the auxiliary driving shaft 15 are both stopped, thereby making the sewing operation terminated.

Furthermore, when the sewing operation after being temporarily terminated is to be resumed, the drawbar 125 is simply pulled upwardly, such that the clutch disk 123 is coupled to the motor flywheel 114, and the first solenoid 1405 and the second solenoid 1404 are both turned off. As the motor unit 11 remains rotating at the high rotation speed even when the sewing operation is temporarily stopped, the sewing operation can be resumed promptly by actuation of the motor flywheel 114.

Therefore, the motor system 1 for the sewing machine according to the present invention can merely use one motor to realize a first speed control, a second speed control and a stopping position control for the sewing mechanism of the sewing machine, without requiring any additional deceleration motor, such that the cost can be reduced. In addition, since the sewing operation can be resumed promptly any time after being temporarily stopped, the sewing quality is assured.

Second Preferred Embodiment

Figure 4:
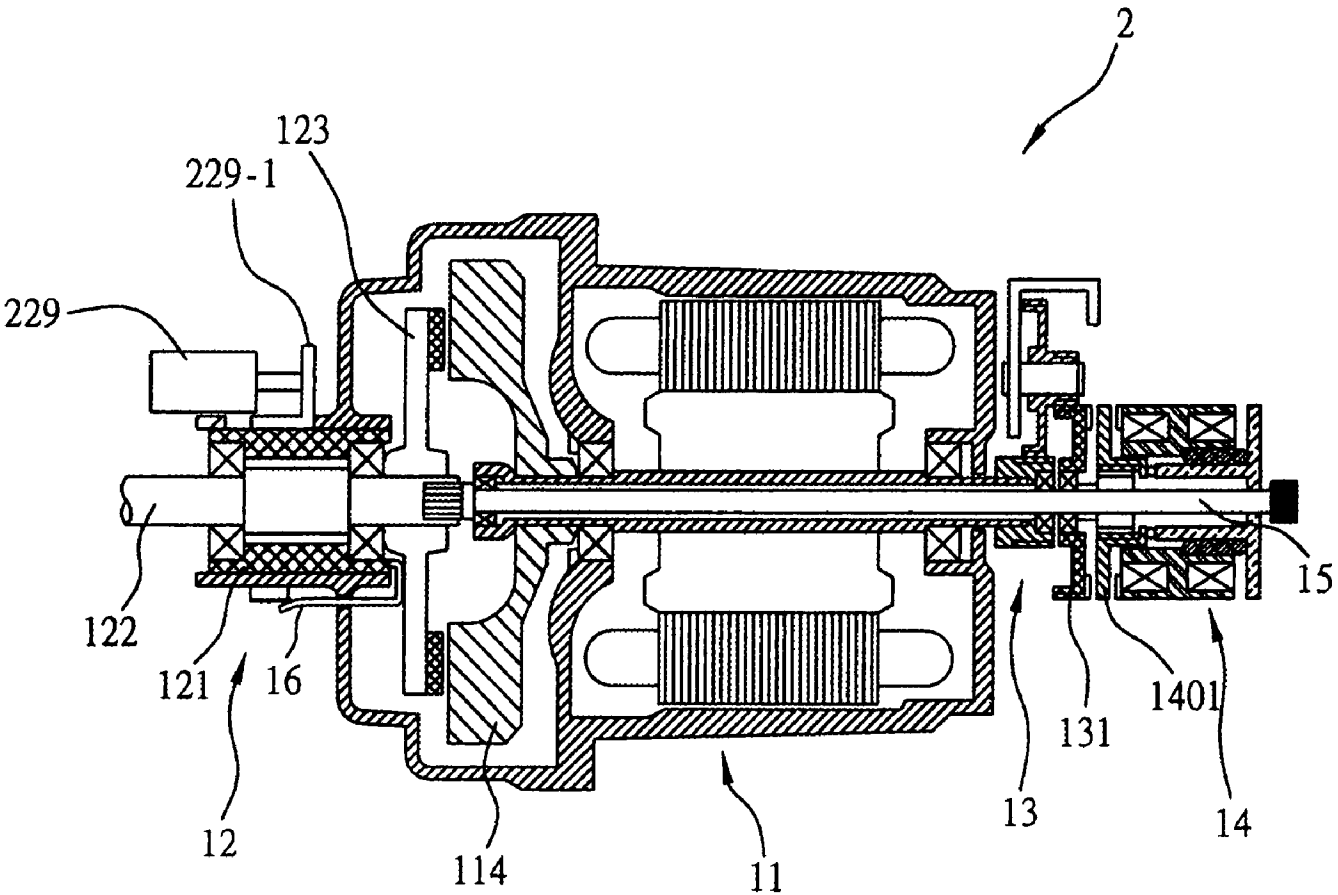
FIG. 4 is a cross-sectional view of a motor system for a sewing machine according to a second preferred embodiment of the present invention.

FIG. 4 is a cross-sectional view of a motor system 2 for a sewing machine according to a second preferred embodiment of the present invention. The motor system 2 in this embodiment is similar to the motor system 1 in the above first embodiment. Thus, only the differences between these two embodiments are described below. In FIG. 4, the same or similar components as or to those in FIG. 1 are designated with the same reference numerals.

As shown in FIG. 4, in the motor system 2 according to the second embodiment of the present invention, the drawbar 125 in the first embodiment is replaced by an automatic driving mechanism 229 having a driving plate 229-1 fixed on the sliding sleeve 121, and the sliding sleeve 121 is driven through the driving plate 229-1 of the automatic driving mechanism 229. The automatic driving mechanism 229 may be an electromagnetic driving mechanism or hydraulic driving mechanism, etc. Therefore, the sewing operation of the sewing machine can be stopped or started by means of e.g. a button or switch that produces a driving signal for actuating the automatic driving mechanism 229.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A motor system for driving a sewing mechanism of a sewing machine, comprising:

a motor unit, which is rotatable at a first rotation speed;

an auxiliary driving shaft, which penetrates the motor unit in a manner free of affecting rotation of the motor unit, and has a first end and a second end opposite to the first end;

a clutch unit at least having an output shaft, wherein the clutch unit is controllable to be coupled to or separated from the motor unit, and wherein an end portion of the output shaft facing toward the motor unit is coupled to the first end of the auxiliary driving shaft so as to allow the output shaft and the auxiliary driving shaft to slide in a longitudinal direction with respect to each other, and the other end portion of the output shaft opposite to the motor unit is for driving the sewing mechanism of the sewing machine;

a speed changing unit mounted on a side of the motor unit opposite to the clutch unit, and having an output portion for switching the first rotation speed of the motor unit to a second rotation speed;

a position control unit mounted on a side of the speed changing unit opposite to the motor unit, the position control unit comprising a sliding disk slidingly connected to the second end of the auxiliary driving shaft in a longitudinal direction, a positioning mechanism for positioning the sliding disk at a first position, a second position or a third position in a contact-free manner, and a brake mechanism, wherein the sliding disk when being situated at the first position is in contact with the output portion of the speed changing unit; the sliding disk when being situated at the second position is free of being in contact with the speed changing unit or the brake mechanism; and the sliding disk when being situated at the third position is in contact with the brake mechanism;

a first sensor for sending a signal according to a status of coupling or separating between the clutch unit and the motor unit; and a second sensor for sending a signal according to an intended stopping position of the sewing mechanism of the sewing machine;

wherein the sliding disk is positioned by the positioning mechanism according to the signals sent from the first sensor and the second sensor.

2. The motor system of claim 1 wherein the second rotation speed is lower than the first rotation speed.

3. The motor system of claim 2, wherein when the clutch unit is coupled to the motor unit, the sliding disk is moved to the second position by the positioning mechanism such that the output shaft is directly actuated by the motor unit to rotate at the first rotation speed; when the clutch unit is separated from the motor unit and the sewing mechanism has not reached the intended stopping position, the sliding disk is moved to the first position by the positioning mechanism such that the output shaft is actuated to rotate at the second rotation speed by the output portion of the speed changing unit via the auxiliary driving shaft; and when the clutch unit is separated from the motor unit and the sewing mechanism has been situated at the intended stopping position, the sliding disk is moved to the third position by the positioning mechanism such that the output shaft is stopped by the brake mechanism via the auxiliary driving shaft.

4. The motor system of claim 1, wherein the motor unit comprises a hollow motor shaft and a motor flywheel fixed on an end portion of the hollow motor shaft facing toward the clutch unit, and the auxiliary driving shaft penetrates the hollow motor shaft in a manner free of affecting rotation of the hollow motor shaft.

5. The motor system of claim 4, wherein the clutch unit further comprises:

a sliding sleeve capable of sliding in its longitudinal direction and rotatably connected to the output shaft; and a clutch disk fixed on the end portion of the output shaft facing toward the motor unit, wherein when the sliding sleeve is situated at a contact position, the clutch disk is in contact with and coupled to the motor flywheel, and when the sliding sleeve is situated at a separation position, the clutch disk is separated from the motor flywheel.

6. The motor system of claim 5, wherein the clutch unit further comprises a drawbar pivoted on the motor unit, and the sliding sleeve is actuated by the drawbar to move to the contact position or the separation position.

7. The motor system of claim 5, wherein the clutch unit further comprises an electromagnetic driving mechanism, and the sliding sleeve is actuated by the electromagnetic driving mechanism to move to the contact position or the separation position.

8. The motor system of claim 5, wherein the clutch unit further comprises a hydraulic driving mechanism, and the sliding sleeve is actuated by the hydraulic driving mechanism to move to the contact position or the separation position.

9. The motor system of claim 1, wherein the position control unit further comprises a driving wheel fixed on the second end of the auxiliary driving shaft and slidingly connected to the sliding disk so as to allow the driving wheel and the sliding disk to slide with respect to each other in the longitudinal direction.

10. The motor system of claim 1, wherein the first sensor is a micro switch.

11. The motor system of claim 1, wherein the second sensor sends the signal when a needle of the sewing mechanism of the sewing machine reaches its topmost position.

12. The motor system of claim 1, wherein the brake mechanism is fixed on the positioning mechanism, and the sliding disk is disposed between the positioning mechanism and the speed changing unit.

13. The motor system of claim 1, wherein the positioning mechanism comprises a first solenoid and a second solenoid, which are disposed oppositely and capable of being turned on or turned off independently.

14. The motor system of claim 13, wherein when the first solenoid is turned on and the second solenoid is turned off, the sliding disk is moved to the first position; when both the first solenoid and the second solenoid are turned off, the sliding disk is moved to the second position; and when the first solenoid is turned off and the second solenoid is turned on, the sliding disk is moved to the third position.

15. The motor system of claim 14, wherein the positioning mechanism further comprises:

a pushing sleeve rotatably abutting against the sliding disk, and attracted by the first solenoid to push the sliding disk to the first position when the first solenoid is turned on; and a spring having elasticity capable of moving the pushing sleeve back to its original position where the sliding disk is free of being pressed by the pushing sleeve when the first solenoid is turned off.

16. The motor system of claim 1, wherein the speed changing unit further comprises a low speed rotating disk, which is rotatable at the second rotation speed and is in contact with and coupled to the sliding disk when the sliding disk is situated at the first position.

* * * * *